United States Patent [19]

Marceau

[11] Patent Number: 4,667,846

[45] Date of Patent: May 26, 1987

[54] TOILET PAPER DISPENSER

[76] Inventor: Ippolito Marceau, N. 438 SOPIM - Commune de Koumassi, Abidjan, Ivory Coast

[21] Appl. No.: 670,479

[22] Filed: Nov. 13, 1984

[30] Foreign Application Priority Data

Nov. 14, 1983 [FR] France ..... 83 18011

[51] Int. Cl.[4] ..... A47K 10/42

[52] U.S. Cl. ..... 221/34; 221/96

[58] Field of Search ..... 221/34–35, 221/96; 222/136; 15/104.94

[56] References Cited

U.S. PATENT DOCUMENTS

| | | | |
|---|---|---|---|
| 2,789,725 | 4/1957 | Carper | 221/96 X |
| 3,141,569 | 7/1964 | Hanson | 221/34 |
| 3,259,139 | 7/1966 | Bell et al. | 221/96 X |
| 3,704,812 | 12/1972 | Marand | 222/136 |
| 3,865,271 | 2/1975 | Gold | 221/96 |
| 3,980,203 | 9/1976 | Dearling | 221/96 |
| 4,436,224 | 3/1984 | McInerny | 221/96 X |

FOREIGN PATENT DOCUMENTS

| | | | |
|---|---|---|---|
| 1353465 | 5/1974 | United Kingdom | 221/96 |
| 2053869 | 2/1981 | United Kingdom | 221/197 |

*Primary Examiner*—Charles A. Marmor

*Attorney, Agent, or Firm*—McGlew and Tuttle

[57] ABSTRACT

This dispenser comprises in combination in a box at least a liquid tank (7), a recess (9) for a supply of cleaning sheets (21) and devices (17,18,19) for distributing on said sheets in the recess (9) a measured amount of liquid contained in the tank (7).

10 Claims, 4 Drawing Figures

FIG. 3
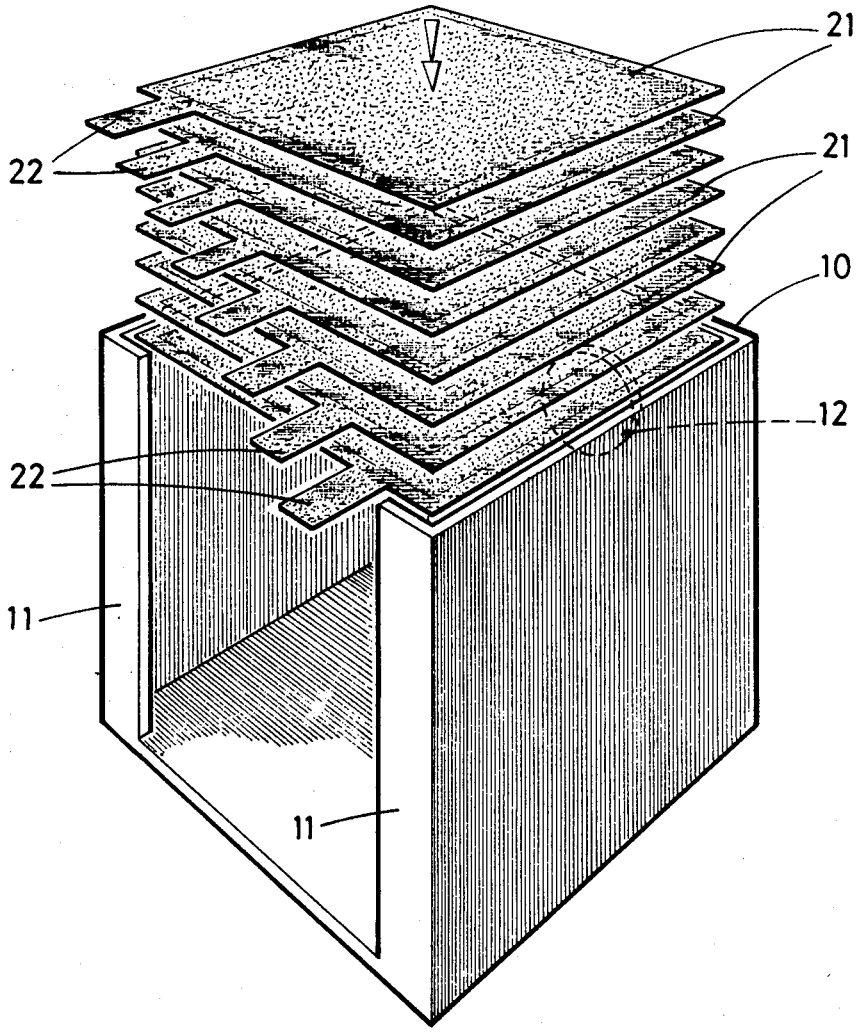
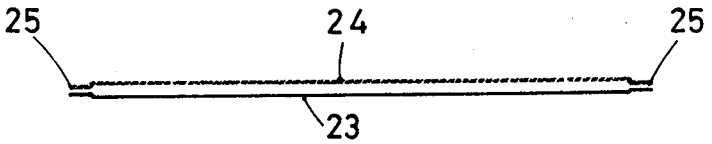
FIG. 4

TOILET PAPER DISPENSER

FIELD AND BACKGROUND OF THE INVENTION

The present invention relates to a toilet paper dispenser.

The usual practice is to provide lavatories with toilet paper dispensers and all the known dispensers are provided with simple sheets of paper which are either in piles or in rolls.

For reasons of hygiene, some people would like to be able to wash themselves, which is usually not possible in conventional lavatory installations.

SUMMARY OF THE INVENTION

An object of the invention is to remedy this situation and to provide an improved toilet paper dispenser which uses a paper which is commercially available and can be wetted, this dispenser being adapted to enable the users to wash themselves rather than to effect a dry cleaning.

The invention therefore provides a toilet paper dispenser which comprises in combination at least a liquid tank, a container for a supply of cleaning sheets and means for distributing on said sheets in said container a measured amount of the liquid contained in said tank.

According to another feature of the invention, the dispenser comprises a box in which is provided at least one compartment for said liquid tank and a container for said supply of sheets.

Preferably, said container for the supply of sheets is removable.

The following description with reference to the accompanying drawings given by way of a non-limiting example will explain how the present invention can be carried out.

BRIEF DESCRIPTION OF THE DRAWINGS

FIG. 3 is a perspective view of the container containing the cleaning sheets, showing the arrangement of the latter.

FIG. 4 is a cross-sectional view of one of the cleaning sheets.

DESCRIPTION OF THE PREFEERED EMBODIMENT

Figure 1:
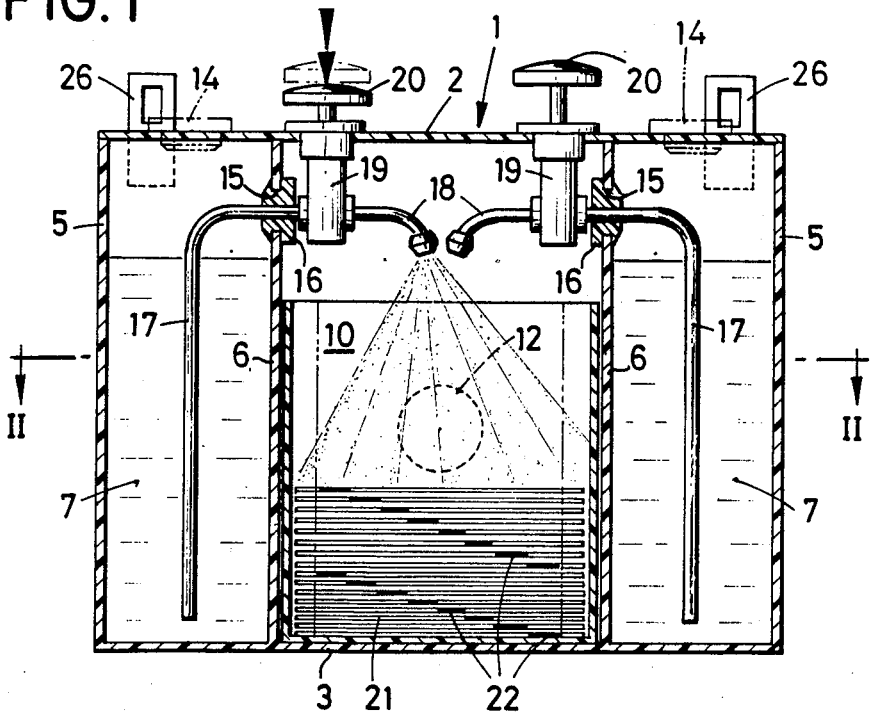
FIG. 1 is an elevational and vertical sectional view of the toilet paper dispenser according to the invention.
Figure 2:
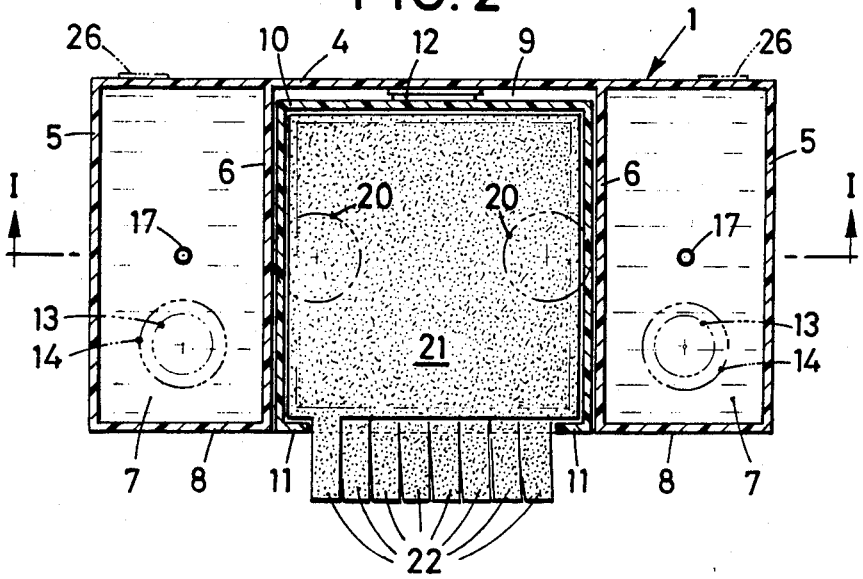
FIG. 2 is a horizontal sectional view taken on line II—II of FIG. 1.

With reference in particular to FIGS. 1 and 2, the toilet paper dispenser according to the invention, generally designated by the reference numeral 1, comprises a box or box-shaped housing which, in the illustrated embodiment, is made from a plastic material and has a rectangular-sided shape including an upper wall 2, a lower wall or bottom 3, a rear wall 4 and two side walls 5.

Two vertical intermediate partition walls 6 parallel to the side walls 5 and spaced from the latter define with the walls 5 and the corresponding parts of the rear wall 4 two compartments 7 which are closed in the front by a wall 8.

In horizontal section (FIG. 2), the considered box thus has a U shape whose two branches are formed by the compartments 7 and whose intermediate part is formed by the portion of the rear wall 4 between the compartments.

The two compartments 7 thus define therebetween a cavity or recess 9 in which is detachably disposed a box-shaped container 10 formed by a box of roughly the shape of a cube open in its upper part, a side adjacent to this upper part having an opening which is slightly narrower and defined by two flanges II (FIG. 3.).

The container 10 is advantageously maintained in the recess 9 for example by means of magnetic discs 12 or by any other suitable removable retaining means.

Each of the compartments 7 has a filling orifice 13 closed by a removable stopper 14.

Each of the inner partition walls 6 defining the compartments 7 is provided with an opening 15 in which is disposed a stopper 16 fitted in a sealed manner in this opening and having extending therethrough in a sealed manner a bent tube whose branch 17 extends down to the vicinity of the bottom of the compartment and whose branch 18 extends towards the interior of the box above the container 10.

The branch 18 of each tube includes a spraying device 19 of a conventional piston type which is fixed in the upper wall 2 of the box and whose actuating push-knob 20 extends outside this wall.

As the spraying devices 19 are of the known conventional type, there is no need to describe them.

The container 10 is provided with a pile of sheets 21 which advantageously have a shape complementary to the shape of the interior of the container 10 and each one has a tab portion 22, the tab portions of the individual sheets being offset from one another so as to enable them to be easily taken hold of individually and pulled outwardly of the container 10 through the open lateral wall of the latter.

The cleaning sheets are advantageously composite sheets of the commercially-available known type and comprise, as shown in FIG. 4, a lower sheet or support 23 of paper or other humidity resistant material and a sheet 24 of a sufficiently strong wiping paper capable of supporting a humidification, the two sheets being fixed together along their edges as shown at 25.

Each of the compartments 7 can be filled with a different liquid, for example one may be a cleaning liquid or a disinfectant and the other a rinsing or neutral liquid.

The user may thus act on the push-knob corresponding to the compartment containing the disinfectant liquid, the spraying device 19 spraying a limited amount of this liquid over the upper absorbent surface of the upper sheet of the pile of sheets 21. Then the user may actuate the second spraying device so as to wet a new sheet with the rinsing liquid.

Advantageously, each compartment 7 may have a transparent part (not shown) so that it is possible to check the level of the liquid in each compartment.

It will of course be understood that the compartments 7 may be open in their upper part and each receive a bottle provided with a spraying device and capable of being withdrawn from above when it is empty so as to be replaced by a new bottle. As this modification is obvious to those skilled in the art, it has not been shown in the drawings.

In the illustrated embodiment, the box has fixing tabs 26 to enable the dispenser to be fastened to a wall in the known manner.

It will of course also be understood that the dispenser according to the invention may be made with smaller dimensions which render it easily transportable.

In a modification (not shown), a single spraying device may be provided which is connected between the ends of the branches 18 or the tubes plunging into the tanks and is adapted to distribute selectively the liquid coming from either of these tanks.

The spraying device or devices may also be electric and supplied with current by a battery (not shown) contained in the box.

What is claimed is:

1. A toilet paper dispenser comprising, a box-shaped housing having a pair of spaced-apart compartments, each compartment comprising a plurality of connected together walls and each compartment being adapted to receive a liquid to be sprayed onto toilet paper, said housing having an at least partly closed cavity between said pair of compartments, a removable box-shaped container removably disposed in said cavity between said pair of compartments, said box-shaped container containing a pile of toilet paper sheets, said compartment having an open top exposing the upper surface of an uppermost sheet in said container, and spray means connected to each compartment and extending over said open top of said removable container and into said cavity for selectively spraying liquid from each of said compartments onto the uppermost surface of an uppermost sheet in said containing er through said open top, said spray means comprising a pair of bent tubes, each bent tube having a first branch into one of said compartments and a second branch extending through one of said wall portions and into said cavity over said container, and a manual spraying device connected to each of said second branches for spraying liquid from one container through one of said bent tubes, said box-shaped housing comprising upper and lower walls, a rear wall interconnecting said upper and lower walls, said upper, lower and rear walls defining said cavity and defining upper, lower and rear wall portions of said compartments, said housing including a pair of side walls connected to said upper, lower and rear walls and closing outer sides of said compartments, and a pair of partition walls closing insides of said compartments and connected between said upper, lower and rear walls, said partition walls disposed on opposite sides of said cavity, said housing including a pair of front walls closing a front of each of said compartments, said box-shaped container having closed rear, bottom and side walls disposed respectively adjacent said rear, lower and partition walls of said housing, said container having a front wall with a pair of spaced-apart flanges defining a front lateral opening for access to a pile of sheets in said container.

2. A dispenser according to claim 1, including a pile of sheets in said container, each sheet having a front edge with a tab extending outwardly through said front lateral opening of said container.

3. A dispenser according to claim 2, wherein said tabs of adjacent sheets and said pile are offset from each other.

4. A dispenser according to claim 3, wherein said second branch of each bent tube extends through one of said partition walls at a location above said container in said cavity.

5. A dispenser according to claim 4, wherein said upper wall has a pair of filling openings therethrough, each filling opening opening into one of said compartments.

6. A dispenser according to claim 5, including a lateral opening in each of said partition walls near a top of each compartment respectively extending between each compartment and said cavity, a stopper with a hole therein disposed in each lateral opening, said second branch of each bent tube extending through the hole of one of said stoppers.

7. A dispenser according to claim 6, wherein each spraying device is mounted to said upper wall and connected to one of said second branches, each spraying device having a push knob above said upper wall.

8. A dispenser according to claim 7, including removable retaining means connected between said rear walls of said housing and container for holding said container in said cavity of said housing.

9. A dispenser according to claim 8, wherein said removable retaining means comprises magnetic discs connected to said rear walls of said housing and container in a position to engage each other when said container is in said cavity.

10. A dispenser according to claim 1, including removable retaining means connected between said rear walls of said housing and container for holding said container in said cavity of said housing.

* * * * *